US009666350B2

(12) United States Patent
Imamura et al.

(10) Patent No.: US 9,666,350 B2
(45) Date of Patent: May 30, 2017

(54) ULTRATHIN ELECTROMAGNETIC STEEL SHEET

(71) Applicant: JFE Steel Corporation, Tokyo (JP)

(72) Inventors: Takeshi Imamura, Tokyo (JP); Minoru Takashima, Tokyo (JP); Tatsuhiko Hiratani, Tokyo (JP)

(73) Assignee: JFE Steel Corporation (JP)

( * ) Notice: Subject to any disclaimer, the term of this patent is extended or adjusted under 35 U.S.C. 154(b) by 279 days.

(21) Appl. No.: 14/353,335

(22) PCT Filed: Nov. 6, 2012

(86) PCT No.: PCT/JP2012/007107
§ 371 (c)(1),
(2) Date: Apr. 22, 2014

(87) PCT Pub. No.: WO2013/069259
PCT Pub. Date: May 16, 2013

(65) Prior Publication Data

US 2014/0255720 A1 Sep. 11, 2014

(30) Foreign Application Priority Data

Nov. 9, 2011 (JP) ..... 2011-245819
Jun. 27, 2012 (JP) ..... 2012-143991

(51) Int. Cl.
*H01F 10/00* (2006.01)
*C22C 38/00* (2006.01)
(Continued)

(52) U.S. Cl.
CPC ..... *H01F 10/007* (2013.01); *C21D 1/74* (2013.01); *C21D 1/76* (2013.01); *C21D 6/008* (2013.01);
(Continued)

(58) Field of Classification Search
CPC ..... C21D 9/46; H01F 1/16; Y10T 428/12431; C22C 38/02
(Continued)

(56) References Cited

U.S. PATENT DOCUMENTS

2003/0116236 A1 6/2003 Hayakawa et al.

FOREIGN PATENT DOCUMENTS

CN 1203635 A 12/1998
CN 1400319 A 3/2003
(Continued)

OTHER PUBLICATIONS

NPL: machine translation of JP2010132977A, Jun. 2010.*
(Continued)

*Primary Examiner* — Jie Yang
(74) *Attorney, Agent, or Firm* — DLA Piper LLP (US)

(57) ABSTRACT

An electrical steel sheet has a component composition including, by mass %, C: 0.007% or less, Si: 4% to 10%, and Mn: 0.005% to 1.0%, the balance being Fe and incidental impurities, as well as a sheet thickness within a range of 0.01 mm or more to 0.10 mm or less, and a profile roughness Pa of 1.0 μm or less. The electrical steel sheet exhibits excellent iron loss properties whereby the magnetic property is free from deterioration, and degradation of the stacking factor can be avoided, even when the steel sheet with a thickness of 0.10 mm or less has been subjected to siliconizing treatment to increase the Si content in the steel.

2 Claims, 3 Drawing Sheets

(51) Int. Cl.

| | |
|---|---|
| ***C22C 38/04*** | (2006.01) |
| ***C22C 38/60*** | (2006.01) |
| ***H01F 1/16*** | (2006.01) |
| ***C22C 38/02*** | (2006.01) |
| ***C22C 38/06*** | (2006.01) |
| ***C22C 38/12*** | (2006.01) |
| ***C21D 1/74*** | (2006.01) |
| ***C21D 1/76*** | (2006.01) |
| ***C21D 6/00*** | (2006.01) |
| ***C21D 9/46*** | (2006.01) |
| ***C23C 10/08*** | (2006.01) |
| *C21D 8/12* | (2006.01) |
| *C21D 8/02* | (2006.01) |

(52) U.S. Cl.
CPC ..... *C21D 8/1255* (2013.01); *C21D 9/46* (2013.01); *C22C 38/00* (2013.01); *C22C 38/002* (2013.01); *C22C 38/004* (2013.01); *C22C 38/008* (2013.01); *C22C 38/02* (2013.01); *C22C 38/04* (2013.01); *C22C 38/06* (2013.01); *C22C 38/12* (2013.01); *C22C 38/60* (2013.01); *C23C 10/08* (2013.01); *H01F 1/16* (2013.01); *C21D 8/0263* (2013.01); *C21D 8/1222* (2013.01); *C21D 8/1233* (2013.01); *C21D 8/1261* (2013.01); *C21D 8/1266* (2013.01); *Y10T 428/12431* (2015.01)

(58) Field of Classification Search
USPC ..... 420/8; 148/111
See application file for complete search history.

(56) References Cited

FOREIGN PATENT DOCUMENTS

| | | | |
|---|---|---|---|
| EP | 0 875 586 A1 | | 11/1998 |
| EP | 0 987 341 A1 | | 3/2000 |
| JP | 5-49745 | | 10/1987 |
| JP | 6-57853 | | 12/1987 |
| JP | 10-219419 | | 8/1998 |
| JP | 11-199988 | | 7/1999 |
| JP | 11-209852 | | 8/1999 |
| JP | 11-293421 | | 10/1999 |
| JP | 11-293449 | | 10/1999 |
| JP | 2001-279403 A | | 10/2001 |
| JP | 2009-263782 | | 11/2009 |
| JP | 2010132977 A | * | 6/2010 |
| TW | 201114922 | | 5/2011 |
| TW | 201134953 | | 10/2011 |

OTHER PUBLICATIONS

NPL: machine translation of JP2009263782A, Nov. 2009.*
Chinese Office Action dated Dec. 17, 2015 of corresponding Chinese Application No. 201280055244.9 along with an English translation of the Search Report.
Office Action of corresponding Taiwanese Application No. 01214/10320633530 dated Feb. 5, 2015 with English translation.
Office Action of corresponding Taiwanese Application No. 101141751 dated Feb. 5, 2015 with English translation.
Taiwanese Official Action dated May 12, 2014 from corresponding Taiwanese Application No. 101141751 with English translation.
Office Action dated May 26, 2015 of corresponding Chinese Patent Application No. 2012800552449 along with an English translation.
Supplemental European Search Report dated Jul. 3, 2015 of corresponding European Application No. 12848485.4.
Korean Office Action dated Aug. 11, 2015 of corresponding Korean Application No. 2014-7011270 along with an English transaltion.
Taiwanese Office Action dated Sep. 21, 2015 of corresponding Taiwanese Application No. 101141751 along with an English translation.
Japanese Office Action dated Nov. 10, 2015 of corresponding Japanese Application No. 2012-143991 along with an English translation.

* cited by examiner (a)

(b)

ULTRATHIN ELECTROMAGNETIC STEEL SHEET

TECHNICAL FIELD

This disclosure relates to an ultrathin electromagnetic steel sheet, also called an ultra-thin electrical steel sheet, hereinafter, which can be suitably applied to a reactor as an inductance element or the like.

BACKGROUND

It is generally known that iron loss of electrical steel sheets drastically increases as the excitation frequency becomes higher. Actually, however, the driving frequency of a transformer or reactor is steadily increased to achieve miniaturization of the iron core and/or improvement in efficiency. As such, the problem of heat generation due to increased iron loss of the electrical steel sheets became more apparent.

To reduce the iron loss of electrical steel sheets, it is known as an effective method to increase the Si content and thereby enhance the specific resistance. However, if the Si content in the steel sheets exceeds 3.5 mass %, workability deteriorates significantly, making it difficult to manufacture steel sheets with high Si content, by a rolling process which had been applied to manufacture conventional electrical steel sheets.

In view of the above, various methods were developed to obtain steel sheets with high Si content. For instance, JP 5049745 B discloses a method wherein an atmospheric gas containing SiCl4 is blown onto the steel sheets at high temperature of 1023° C. to 1200° C. to obtain an electrical steel sheet with high Si content. Further, JP 6057853 B discloses a method of carrying out hot rolling in manufacturing a high Si steel sheet with poor workability due to Si content of 4.5 mass % to 7 mass %.

It is effective to decrease the sheet thickness to reduce the iron loss. Among the above-mentioned methods, there is limitation in decreasing the sheet thickness by the method involving hot rolling. Thus, a method utilizing $SiCl_4$ has been industrialized, which is referred to as "siliconizing treatment".

However, it has been revealed that if the siliconizing treatment is applied to steel sheets with a thickness reduced to increase the Si content in the steel, the magnetic property may deteriorate. It has also been revealed that if the steel sheets are stacked on each other, as is the case in many instances, the stacking factor may significantly deteriorate.

It could therefore be helpful to provide an ultra-thin electrical steel sheet that exhibits excellent iron loss properties whereby the magnetic property is free from deterioration and degradation of the stacking factor can be avoided, even when the steel sheet with a thickness of 0.10 mm (100 μm) or less has been subjected to siliconizing treatment for increasing the Si content in the steel.

SUMMARY

We provide an ultra-thin electrical steel sheet having a component composition including, by mass %: C: 0.007% or less, Si: 4% to 10%, and Mn: 0.005% to 1.0%, the balance being Fe and incidental impurities, wherein the electrical steel sheet has a sheet thickness of 0.01 mm or more to 0.10 mm or less, and a profile roughness Pa of 1.0 μm or less.

We also provide the ultra-thin electrical steel sheet according to claim 3, further including, by mass %, at least one of Ni: 0.010% to 1.50%, Cr: 0.01% to 0.50%, Cu: 0.01% to 0.50%, P: 0.005% to 0.50%, Sn: 0.005% to 0.50%, Sb: 0.005% to 0.50%, Bi: 0.005% to 0.50%, Mo: 0.005% to 0.100%, and Al: 0.02% to 6.0%.

It is possible to advantageously avoid deterioration of the magnetic property and decrease in the stacking factor, which had been conventionally caused in thin electrical steel sheets during the siliconizing treatment by means of SiCl4 for increasing the Si content in the steel, and to thereby stably obtain an ultra-thin electrical steel sheet excellent in magnetic property.

REFERENCE NUMERALS

1 . . . Nozzles
2 . . . Steel sheet
3 . . . Shield plates

DETAILED DESCRIPTION

Our steel sheets were successfully achieved starting from experiments described below.

Experiment 1

A steel slab containing C: 0.0045%, Si: 3.40% and Mn: 0.10%, all by mass %, was subjected to hot rolling to obtain a hot rolled steel sheet having a sheet thickness of 2.0 mm. The hot rolled steel sheet was then subjected to pickling to remove scale, followed by cold rolling to manufacture a steel sheet having a final thickness of 0.05 mm. Subsequently, siliconizing treatments were executed at various temperatures of 1000° C. to 1200° C., and for various times of 100 sec to 1400 sec, under an atmosphere of 10% $SiCl_4$+90% $N_2$. The siliconizing treatment under each condition was carried out to achieve a uniform Si content of 6.5 mass % in the sheet thickness direction, based on advance calculation and review. Consequently, the Si content of each sample obtained as above was substantially constant value of about 6.5 mass %.

Figure 1:
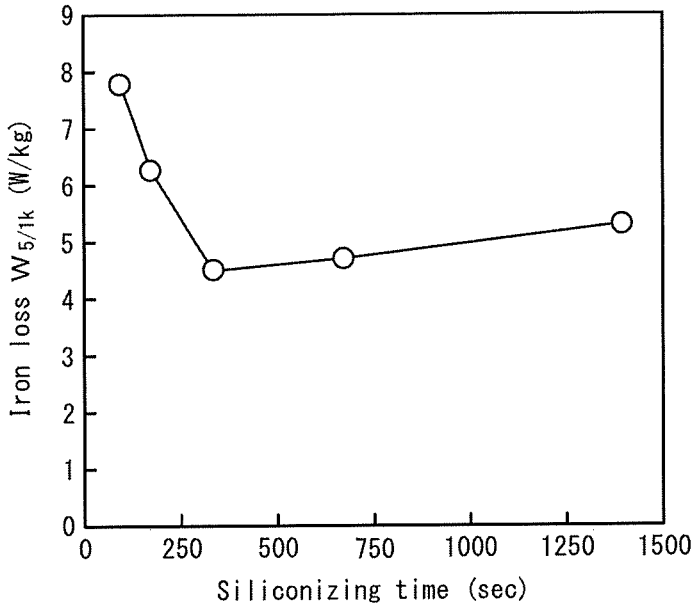
FIG. 1 shows the relationship between the siliconizing treatment time and the iron loss$W_{5/1k}$.

The magnetic property of the samples was measured by the method prescribed by JIS C 2550. FIG. 1 shows the relationship between the siliconizing time and iron loss $W_{5/1k}$ (i.e., an iron loss at magnetic flux density of 0.5T and frequency of 1000 Hz). Based on the measurement results, we clarified that the iron loss is reduced by extending the siliconizing time longer than a certain time. Also, the stacking factor of the steel sheets was measured by the method prescribed by JIS C 2550. As a result, we found that the stacking factor increases to an excellent degree, as the treatment time (siliconizing time) becomes longer.

Figure 2:
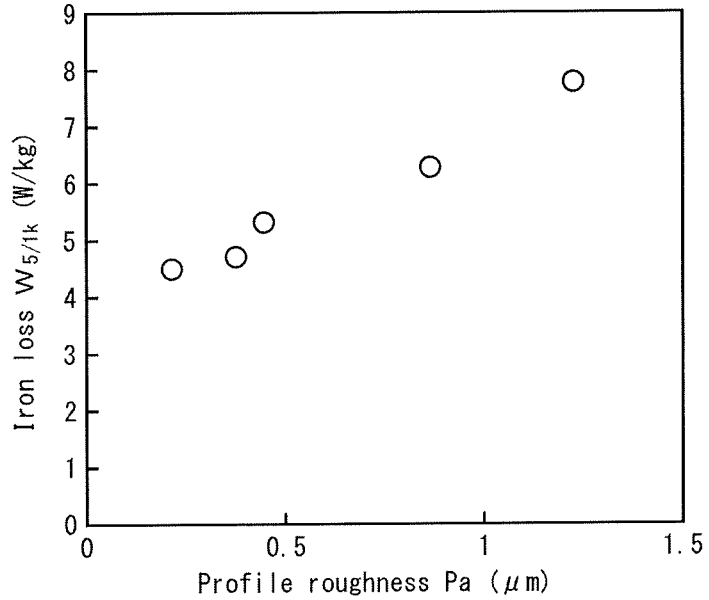
FIG. 2 shows the relationship between the profile roughness Pa of a steel sheet and the iron loss$W_{5/1k}$.

As the stacking factor is greatly influenced by the surface roughness of the steel sheet, the surface roughness of each sample was investigated. The surface roughness of the steel sheet was measured by the method prescribed by JIS B 0633 '01. In this instance, a measuring device was used, which included a stylus having a tip radius of 2 μm. FIG. 2 shows the results in relation to the iron loss properties. With reference to FIG. 2, it is clear that the iron loss is lower and better, as the profile roughness Pa is smaller. The term "profile roughness Pa" means an arithmetical mean deviation of the assessed profile (primary profile) prescribed by JIS B 0601 '01.

In general, it is believed that iron loss deteriorates, as surface roughness increases, because the surfaces unevenness prevents movement of the magnetic domain-wall. Thus, to investigate whether it is only the surface layer which plays an influential role, the cross-sectional shape of steel sheets was investigated in detail by a laser shape measuring device. As a result, we clarified that the unevenness on one side surface substantially corresponds to that on the reverse surface. In other words, samples having a large surface roughness may be regarded as sheets waving minutely as a whole, wherein the unevenness exists not only on one side surface. This is believed to be a phenomenon unique to thin steel sheets that have been subjected to siliconizing treatment.

Figure 3:
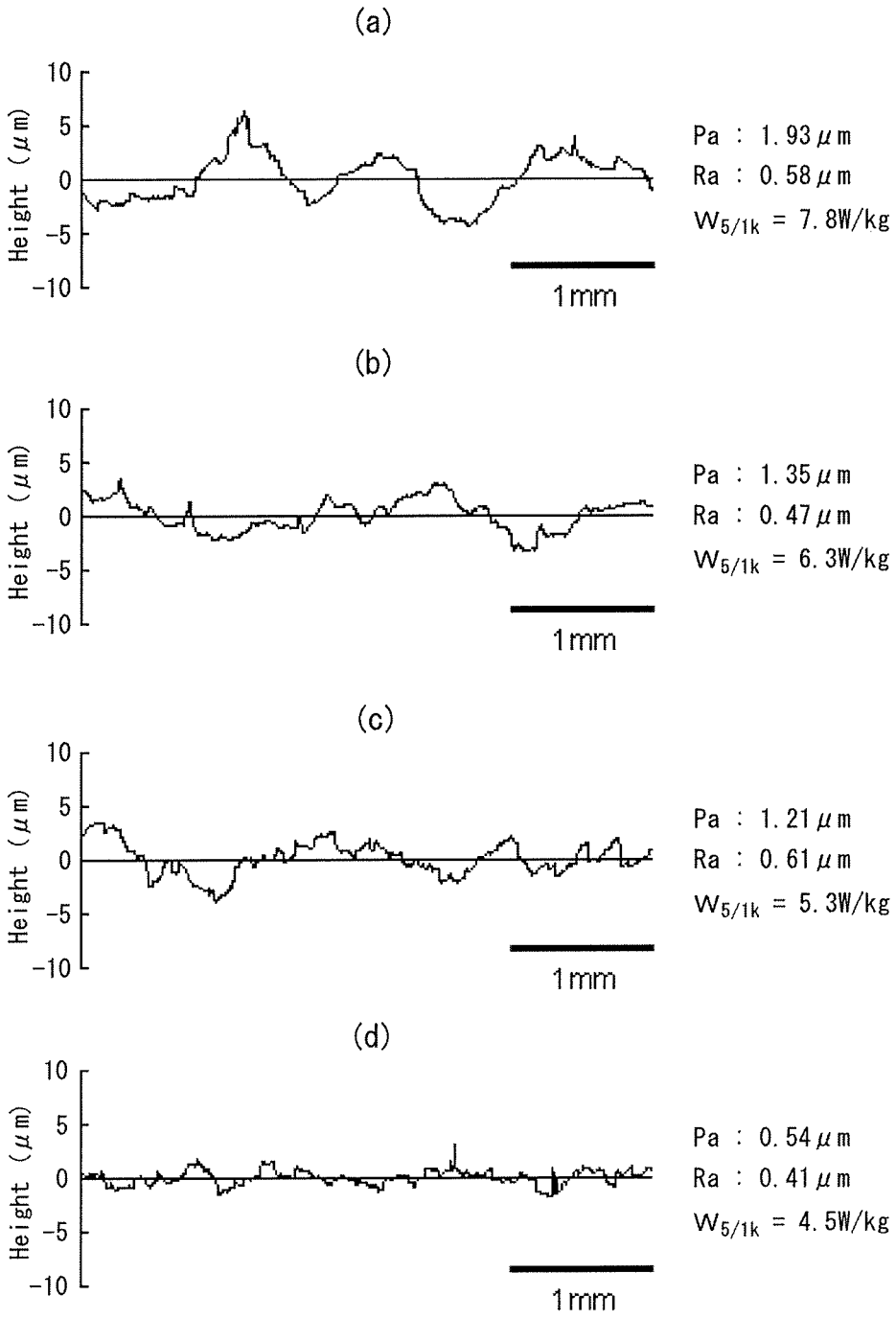
FIG. 3 show primary profiles obtained by measuring the roughness, together with the profile roughness Pa, the arithmetical mean roughness Ra and the iron loss$W_{5/1k}$.

FIGS. 3(*a*) to 3(*d*) show part of the results of investigation relating to the surface roughness of the samples obtained by our experiment, indicating the measured values of the profile roughness Pa and the arithmetical mean roughness Ra as the surface roughness besides the values of the iron loss $W_{5/1k}$. With reference to the relationship between the profile roughness Pa and the iron loss $W_{5/1k}$, similarly to FIG. 2, FIGS. 3(*a*) to 3(*d*) show that Pa is well correlated to $W_{5/1k}$, namely $W_{5/1k}$ decreases, as Pa is made smaller. In contrast, regarding the relationship between the arithmetical mean roughness Ra and the iron loss $W_{5/1k}$, we clarified by comparing FIG. 3 (*a*) and (*c*), that even though FIG. 3(*c*) shows Ra as 0.61 μm, while FIG. 3(*a*) shows smaller Ra as 0.58 μm, FIG. 3(*a*) shows higher $W_{5/1k}$ of 7.8 W/kg as compared to $W_{5/1k}$ of 5.3 W/kg shown in FIG. 3 (*c*). Therefore, in the case of a thin steel sheet with waviness being recognized, taking into account a primary profile, the profile roughness Pa is believed to be more suitable as a parameter indicating the surface texture than the generally adopted arithmetical mean roughness Ra.

As shown in FIG. 1, the longer the siliconizing time is, the smaller the profile roughness Pa becomes, that is, waviness becomes smaller. The reason for this is not yet fully clarified, though we believe it is as follows:

Namely, upon the siliconizing treatment using silicon tetrachloride, we believe that the following reaction occurs:

$$SiCl_4+5Fe \rightarrow Fe_3Si+2FeCl_2$$

Namely, Fe is partly replaced by Si and discharged outside the system as the gas chloride. On this occasion, on the steel sheet surface where the reaction is in progress by replacing Si that is small in volume, a volume shrinkage occurs. The total amount of this volume shrinkage remains the same as far as the final amount treated by siliconizing is the same, though the volume varies more significantly per unit time as the annealing time is made shorter. When the volume varies rapidly per unit time, this might be a factor causing waviness in steel sheets.

In this instance, what is important is that deterioration of the magnetic property is caused primarily by the waviness in steel sheets, rather than the length of annealing time. Namely, even when the annealing time is short, if the steel sheet is free from waviness, the magnetic property would not likely deteriorate. There may be considered various methods of preventing the waviness and reducing the profile roughness Pa, e.g., decreasing the line tension applied during the sheet passage to prevent deflection upon the siliconizing treatment, carrying out siliconizing treatment intermittently, as well as placing the steel sheets along supporting rolls upon the siliconizing treatment.

Upon industrial manufacturing of the electrical steel sheets, it is undesirable to extend the annealing time as was done in our experiment since extended annealing time results in lowering productivity. Among the methods as noted above, the method decreasing the line tension was applied to find out that the tendency to reduce the arithmetical mean roughness Ra was confirmed, though the tendency to decrease the profile roughness Pa could not always be recognized. It is assumed that decreasing the line tension also caused a decrease in the tensile force in the sheet widthwise direction, which could not thus improve the waviness in steel sheets. In addition, as explained with reference to the examples described below, when it is difficult to take longer annealing times for practical reasons, it is preferred to apply a plurality of methods, for instance, in addition to decreasing the line tension, an atmosphere for the siliconizing treatment may be applied intermittently to the steel sheets.

Also, upon industrial manufacturing of the electrical steel sheets, the waviness in the steel sheets are mostly formed in parallel to the rolling direction, under the influence of the line tension applied during the siliconizing treatment. Thus, in measuring the profile roughness Pa linearly, it is necessary to carry out the measurements in the direction perpendicular to the rolling direction. Hence, the measurement as discussed herein was carried out in the direction perpendicular to the rolling direction.

As described above, we determined the cause for the concern that during siliconizing thin electrical steel sheets using $SiCl_4$ to increase the Si content in the steel, the magnetic property deteriorates and the stacking factor decreases, and succeeded in eliminating such problems by regulating the causal factors based on the profile roughness Pa.

That is, primary features of our sheets are as follows:

A first aspect resides in an ultra-thin electrical steel sheet having a component composition including, by mass %:

C: 0.007% or less,

Si: 4% to 10%, and

Mn: 0.005% to 1.0%, the balance being Fe and incidental impurities, wherein the electrical steel sheet has a sheet thickness within a range of 0.01 mm or more to 0.10 mm or less, and a profile roughness Pa of 1.0 μm or less.

A second aspect resides in an ultra-thin electrical steel sheet, further including, by mass %, at least one of Ni: 0.010% to 1.50%, Cr: 0.01% to 0.50%, Cu: 0.01% to 0.50%, P: 0.005% to 0.50%, Sn: 0.005% to 0.50%, Sb: 0.005% to 0.50%, Bi: 0.005% to 0.50%, Mo: 0.005% to 0.100%, and Al: 0.02% to 6.0%.

Our steel sheets have a specific component composition which is limited to the above range for the reasons to be described below, where the unit "%" relating to the following component elements refers to "mass %" unless specified otherwise.

C: C≤0.007%

Carbon (C) is an element giving rise to deterioration of magnetic property due to magnetic aging. Thus, C is preferably reduced as best as possible. However, it is difficult to remove C completely. Thus, enormous production cost is necessary in achieving the complete removal of C. Therefore, C content is defined to be 0.007% or less. As far as C content stays not exceeding the aforementioned limit, C does not cause any problem in terms of the magnetic property.

Si: 4%≤Si≤10%

In light of final product sheets, Silicon (Si) is an element necessary to enhance steel specific resistance and improve iron loss. As our steel sheets presuppose a siliconizing treatment, Si content needs to be 4% or more. On the other hand, if Si content exceeds 10%, saturation magnetic flux density decreases significantly. Therefore, Si content is 4% to 10%.

Mn: 0.005%≤Mn≤1.0%

Manganese (Mn) is an element contributing effectively to improving workability during hot rolling. However, if an Mn content is less than 0.005%, the effect of improve workability is small. On the other hand, an Mn content in excess of 1.0% has saturation magnetic flux density decreased and thus magnetic property deteriorates also. Therefore, Mn content is 0.005% to 1.0%.

In addition to the aforementioned basic components, the steel sheets may also include at least one of the elements stated below in an appropriate manner as necessary, that is; Ni: 0.010% to 1.50%, Cr: 0.01% to 0.50%, Cu: 0.01% to 0.50%, P: 0.005% to 0.50%, Sn: 0.005% to 0.50%, Sb: 0.005% to 0.50%, Bi: 0.005% to 0.50%, Mo: 0.005% to 0.100% and Al: 0.02% to 6.0%.

Namely, nickel (Ni) can be added to improve magnetic property. However, if the Ni content is less than 0.010%, an improved amount of magnetic property is small. On the other hand, the Ni content in excess of 1.50% causes decline in saturation magnetic flux density, causing deterioration of magnetic property. Therefore, the Ni content is 0.010% to 1.50%.

Also, to decrease iron loss, the following can be added singly or multiply, that is; Cr: 0.01% to 0.50%, Cu: 0.01% to 0.50%, P: 0.005% to 0.50% and Al: 0.02% to 6.0%.

Moreover, to improve magnetic flux density, the followings can be added singly or multiply, that is; Sn: 0.005% to 0.50%, Sb: 0.005% to 0.50%, Bi: 0.005% to 0.50% and Mo: 0.005% to 0.100%. Each addition of amount less than the lower limit amount cannot sufficiently cause the good effect of improving magnetic property. On the other hand, each addition of amount in excess of the upper limit amount has saturation magnetic flux density decreased, thus causing deterioration of magnetic property.

Next, reasons why sheet thickness and profile roughness Pa are to be restricted as above will be described hereinafter.

Sheet Thickness: 0.01 mm≤Sheet Thickness≤0.10 mm

Deterioration of magnetic property due to the surface roughness of the steel sheet, significantly occurs to thin steel sheets. Thus, a sheet thickness of the electrical steel sheet is 0.10 mm or less. However, the sheet thickness less than 0.01 mm causes difficulty during sheet passage at siliconizing treatment facilities. Therefore, the sheet thickness is 0.01 mm or more.

Profile Roughness Pa: Pa≤1.0 μm

As described above, the magnetic property of the ultra-thin electrical steel sheet is very closely correlated to the profile roughness Pa. Thus, it is possible to obtain an excellent magnetic property by decreasing Pa to 1.0 μm or less. Therefore, the surface roughness of the steel sheet is restricted as the profile roughness Pa of 1.0 μm or less, preferably 0.4 μm or less, more preferably 0.3 μm or less.

Next, the preferable manufacturing method of the steel sheet will be described.

Manufacturing methods of general electrical steel sheets can be applicable. Namely, the method is as follows: molten steel adjusted in composition thereof as prescribed is processed to manufacture the corresponding steel slab, which is subjected to hot rolling to obtain hot rolled steel sheets. The hot rolled steel sheets obtained are then subjected to hot-band annealing as necessary, subjected to cold rolling once, or twice or more with an intermediate annealing performed there between to obtain cold rolled steel sheets having the final sheet thickness. The cold rolled steel sheets obtained are subsequently subjected to annealing as necessary, siliconizing treatment and then coating process.

During the above mentioned processes, the siliconizing treatment utilizing $SiCl_4$ is essential. In addition, cold rolling, primary recrystallization annealing and secondary recrystallization annealing, as well as removing a hard coating from the surface of the steel sheet and subsequent siliconizing treatment, are especially desirable, as making it possible to obtain the high magnetic flux density property. In this case, re-rolling may be carried out to obtain a prescribed sheet thickness after removal of the hard coating and before the siliconizing treatment to maintain the high magnetic flux density.

Hereinafter, the production steps will be described concretely. Molten steel having the above component composition may be subjected to the conventional ingot-making or continuous casting methods to obtain a slab. Or a thin cast slab/strip having a thickness of 100 mm or less may be prepared by direct casting. The slab may be heated by conventional methods of hot rolling or directly brought to hot rolling after casting without heating. The thin cast slab/strip may be either hot rolled or directly fed to the next process skipping hot rolling. In light of costs, it is preferable that a slab heating temperature before hot rolling is a low temperature of 1250° C. or less. But in the case of utilizing secondary recrystallization, the slab shall be preferably heated up to a temperature of 1400° C. approximately.

Subsequently, the hot rolled steel sheets obtained are subjected to hot-band annealing as necessary. To obtain a good magnetic property, the hot-band annealing temperature is preferably 800° C. or more to 1150° C. or less. When the hot-band annealing temperature is lower than 800° C., a band structure derived from hot rolling is retained, it is thereby difficult to realize primary recrystallized structure constituted of uniformly-sized grains, thus the magnetic property deteriorates. On the other hand, in the case of the hot-band annealing temperature exceeding 1150° C., grains in the steel sheets after hot-band annealing are exceedingly coarsened, which is very disadvantageous in terms of realizing primary recrystallized structure constitution of uniformly-sized grains.

After the above hot-band annealing, the hot rolled steel sheets are subjected to cold rolling once, or twice or more with an intermediate annealing performed therebetween, subsequent annealing as necessary and then siliconizing treatment. It is effective to improve magnetic property to execute cold rolling at a high temperature of 100° C. to 300° C. and also to implement an aging treatment once, or more than once at a temperature of 100° C. to 300° C. in the middle of cold rolling.

It is preferred to carry out siliconizing treatment at a high temperature of approximately 1200° C. However, as mentioned earlier in the case where waviness occurs in steel sheets, the temperature of siliconizing treatment can be decreased without a problem. Also, to decrease waviness in steel sheets and reduce profile roughness Pa, besides prolonging annealing time, there are methods such as executing intermittent siliconizing treatment, applying supporting rolls and reducing line tension. However, these method are not limited.

In the experiment we clarified that Pa could not be reduced readily. Thus, we believe it to be necessary that during intermittent siliconizing treatment at least by controlling an atmosphere, also line tension is decreased.

Figure 4:
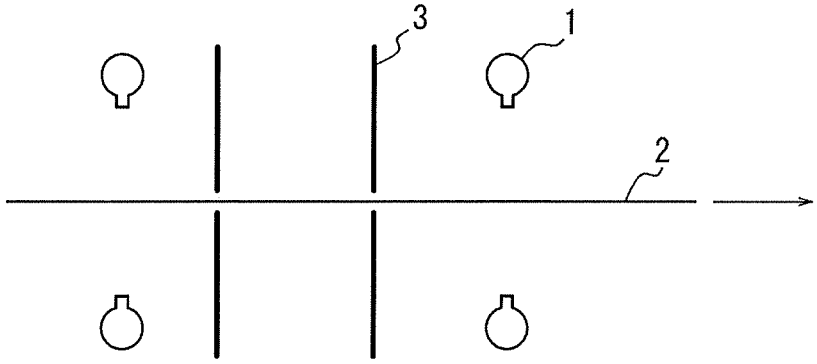
FIG. 4 show arrangements of blowing nozzles and shield plates that are utilized during the intermittent or continuous siliconizing treatments at a continuous line.
Figure 4:
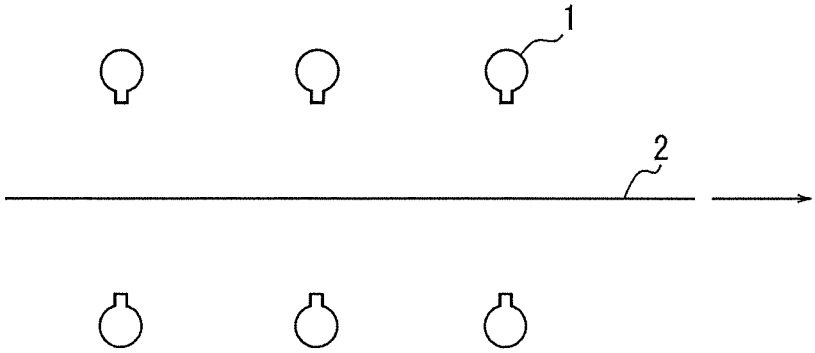

The term "intermittent siliconizing treatment" means that, during siliconizing treatment, atmosphere suitable for siliconization is intermittently applied, alternatingly to atmosphere that does not contribute to siliconization. Concretely, in the case of siliconizing at a continuous line, there is a method as shown in FIG. 4 (*a*), namely, a plurality of nozzles 1 are arranged in the direction of sheet passage of a steel sheet 2 for blasting source gas to siliconize and a pair of shield plates 3 are provided between these nozzles to shield the source gas from the nozzles 1 to prevent siliconizing between the pair of the shield plates.

In addition, when siliconizing treatment time is shortened, the steel sheet with different Si contents between a surface layer and a central layer in sheet thickness is obtained, which is preferred, because magnetic property thus becomes good in high frequency excitation. Also in this case, a component composition should be considered as values averaged within a whole sheet thickness. After the siliconizing treatment, it is effective in a case utilized under a stacked condition, to provide insulating coating to ensure insulation property of steel sheets.

Example 1

Steel slab having the component composition including C: 0.0031%, Si: 3.05%, Mn: 0.15%, the balance being Fe and incidental impurities, was manufactured by continuous casting. The steel slab obtained was subjected to heating at a temperature of 1150° C. and hot rolling to obtain hot rolled steel sheets having a sheet thickness of 2.0 mm. Subsequently, the hot rolled steel sheets were subjected to hot-band annealing at a temperature of 1000° C. for 30 sec, cold rolling for obtaining the final sheet thickness of 0.075 mm, and then siliconizing treatment in the atmosphere of 10% $SiCl_4$+90% Ar at a temperature of 1100° C. for 600 sec. At that time, in the annealing furnace, as shown in FIG. 4 (*a*), a plurality of nozzles 1 were arranged near both sides of a steel sheet 2 for blasting source gas, and also a pair of shield plates 3 shielding source gas were provided between the nozzles to execute the siliconizing treatment by the source gas near the nozzles 1, while preventing siliconizing between the shield plates 3, thus executing the intermittent siliconizing treatment. For some samples, as shown in FIG. 4 (*b*), the siliconizing treatment was executed without the shield plates of executing the continuous siliconizing treatment by a plurality of nozzles 1. In addition, line tensions at sheet passage during the siliconizing treatments were changed variously according to Table 1.

Si contents of the sample obtained were 5.54%, which were distributed substantially uniformly in the direction of sheet thickness.

Moreover, the magnetic properties and stacking factors thereof were measured by the method as prescribed by JIS C 2550 and also the profile roughness Pa was measured in conformity to the regulations as prescribed by JIS B 0633 '01.

The results obtained are also shown in Table 1.

TABLE 1

| No. | Line tension (MPa) | Type of siliconizing treatment | Profile roughness (Pa) (μm) | Iron loss $W_{5/1k}$ (W/kg) | Stacking factor (%) | Remarks |
|---|---|---|---|---|---|---|
| 1 | 0.5 | Intermittent | 0.18 | 5.7 | 99.2 | Inventive example |
| 2 | 1.0 | Intermittent | 0.27 | 5.9 | 98.6 | Inventive example |
| 3 | 2.5 | Intermittent | 0.55 | 6.5 | 96.5 | Inventive example |
| 4 | 5.0 | Intermittent | 1.56 | 10.2 | 89.8 | Comparative example |
| 5 | 1.0 | Continuous | 1.22 | 8.1 | 91.0 | Comparative example |

It is apparent from Table 1 that the magnetic properties are good as well as the stacking factors are high in the case of decreasing the line tensions and executing the intermittent siliconizing treatments to adjust the profile roughness Pa within our range.

Example 2

Steel slabs having various component compositions as shown in Table 2 were manufactured by continuous casting. The steel slabs obtained were subjected to heating at a temperature of 1200° C. and hot rolling to obtain hot rolled steel sheets having a sheet thickness of 2.7 mm. Subsequently, the hot rolled steel sheets were subjected to hot-band annealing at a temperature of 900° C. for 30 sec, cold rolling to obtain the final sheet thickness of 0.050 mm, and then siliconizing treatment in the atmosphere of 15% $SiCl_4$+85% $N_2$ at a temperature of 1200° C. for 100 sec. At that time, in the annealing furnace as shown in FIG. 4 (*a*), a plurality of nozzles 1 were arranged near both sides of a steel sheet 2 as a blasting source gas, and also a pair of shield plates 3 shielding source gas were provided between the nozzles to execute the siliconizing treatment by the source gas near the nozzles 1, while preventing siliconizing between the shield plates 3, thus executing the intermittent siliconizing treatment. The line tension at sheet passage was 1.0 MPa and thus both of the above countermeasures were believed to be the conditions to decrease waviness in steel sheets.

The profile roughness Pa of the samples obtained were measured in conformity to the regulations as defined by JIS B 0633 '01 and, as a result, the profile roughness Pa thereof were 0.25 μm to 0.36 μm, which achieved our range. In addition, the magnetic properties of the samples obtained were measured by the method as prescribed in JIS C 2550 as well as the final components in the steel were analyzed.

The results obtained are also shown in Table 2.

TABLE 2

| | Component composition (mass %) | | | | $W_{5/1k}$ | |
|---|---|---|---|---|---|---|
| No. | C | Si | Mn | Others | (W/kg) | Remarks |
| 1 | 0.004 | 6.54 | 0.06 | — | 5.7 | Inventive example |
| 2 | 0.005 | 3.42 | 0.07 | — | 11.4 | Comparative example |
| 3 | 0.003 | 5.56 | 0.09 | — | 4.5 | Inventive example |
| 4 | 0.003 | 4.22 | 0.12 | Sb: 0.04 | 4.9 | Inventive example |
| 5 | 0.003 | 8.65 | 0.25 | P: 0.008, Ni: 0.12 | 5.1 | Inventive example |
| 6 | 0.004 | 5.55 | 0.08 | Al: 3.1 | 3.2 | Inventive example |
| 7 | 0.004 | 6.50 | 0.45 | Cr: 0.05, Bi: 0.12 | 4.9 | Inventive example |
| 8 | 0.002 | 6.49 | 0.01 | Cu: 0.02, Sn: 0.12, Mo: 0.06 | 4.3 | Inventive example |

It is apparent from Table 2 that all the inventive examples satisfying our component compositions range achieve the excellent magnetic properties.

INDUSTRIAL APPLICABILITY

The thin electrical steel sheet having high Si content is particularly excellent in high frequency iron loss, which can be thus suitably applied to materials for iron cores of small-sized transformers, motors, reactors and the like.

The invention claimed is:

1. An ultra-thin electrical steel sheet having a component composition including, by mass %:

C: 0.007% or less,

Si: 4% to 10%, and

Mn: 0.005% to 1.0%, the balance being Fe and incidental impurities, wherein the electrical steel sheet has a sheet thickness of 0.01 mm or more to 0.10 mm or less, and a profile roughness Pa, defined as an arithmetic mean deviation of an assessed profile according to JIS B 0601 (2001), of 1.0 μm or less.

2. The ultra-thin electrical steel sheet according to claim 1, further including, by mass %, at least one of Ni: 0.010% to 1.50%, Cr: 0.01% to 0.50%, Cu: 0.01% to 0.50%, P: 0.005% to 0.50%, Sn: 0.005% to 0.50%, Sb: 0.005% to 0.50%, Bi: 0.005% to 0.50%, Mo: 0.005% to 0.100%, and Al: 0.02% to 6.0%.

* * * * *